United States Patent [19]

Peters

[11] Patent Number: 4,510,561

[45] Date of Patent: Apr. 9, 1985

[54] FLASHLIGHT-SCREWDRIVER COMBINATION

[76] Inventor: Raymond A. Peters, 521 W. 159th St., New York, N.Y. 10032

[21] Appl. No.: 591,271

[22] Filed: Mar. 19, 1984

[51] Int. Cl.[3] ..... F21L 15/12

[52] U.S. Cl. ..... 362/399; 362/120; 362/190; 362/253; 362/382; 362/396

[58] Field of Search ..... 360/120, 253, 190, 382, 360/399, 396

[56] References Cited

U.S. PATENT DOCUMENTS 1,309,363 7/1919 Meinke ..... 362/120

*Primary Examiner*—Stephen J. Lechert, Jr.

*Attorney, Agent, or Firm*—Howard M. Schwinger

[57] ABSTRACT

A flashlight screwdriver combination, the screwdriver being carried by a holder of the approximate size and shape of the flashlight it is to contain, the holder being of flexible construction and having a flashlight access permitting the flashlight to be squeezed into the holder, the holder carrying an axially mounted clamp at its front end, the clamp for holding a screw driver.

1 Claim, 2 Drawing Figures

FLASHLIGHT-SCREWDRIVER COMBINATION

This invention relates to flashlights and more particularly, to a flashlight screwdriver combination.

Although flashlight screwdriver combinations have heretofore been proposed, the devices of the prior art have been seriously deficient in several important respects.

It will be realized that when working in poorly lit areas generally of very limited accessibility, a screwdriver in combination with a flashlight can be of great value. Such areas are generally recessed and obstructed and are out of the range of available lighting. If a screwdriver is used in one hand with a flashlight in the other, the screwdriver hand will generally block light from the flashlight. Similarly, the screwdriver hand will block light from any auxiliary source.

If the two devices could be conveniently combined into one instrument with the screwdriver forward of the flashlight and aligned along its axis, a solution to the problem will have been provided.

It is thus a primary object of the present invention to provide a flashlight and screwdriver in combination wherein the screwdriver is maintained in the axis of the flashlight.

It is another important object of the present invention to provide a flashlight and screwdriver in combination without modifying either the flashlight or screwdriver.

It is yet another object of the present invention to provide a flashlight and screwdriver in combination which can enter into relatively inaccessible places.

Figure 1:
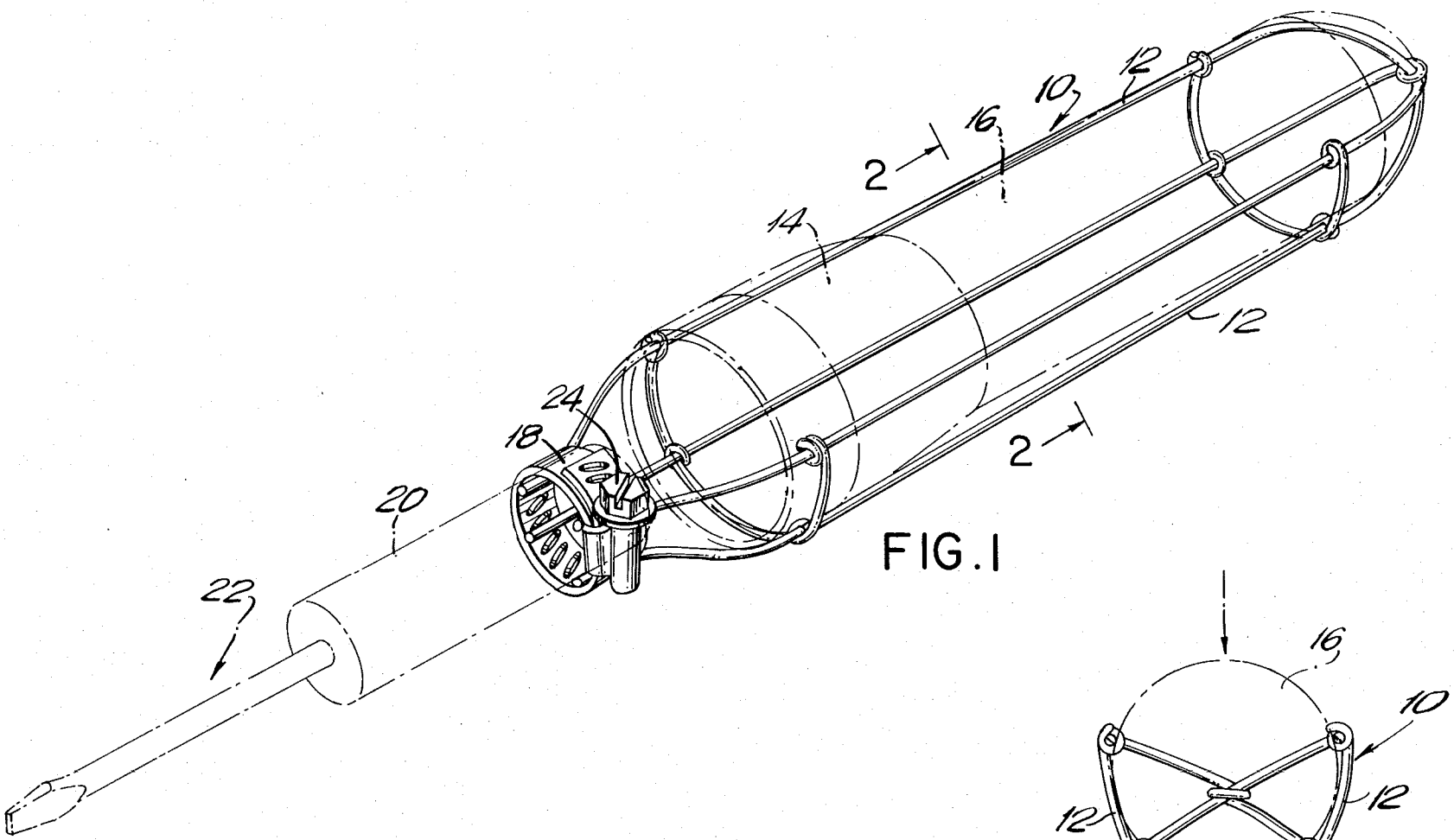
Figure 2:
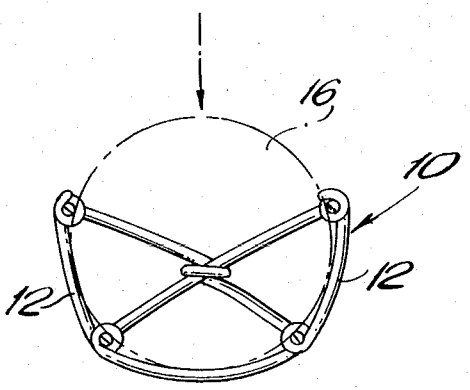

Other objects and advantages of the present invention will become apparent from a reading of the following specification with drawing wherein:

FIG. 1 is a perspective view of one embodiment of the holder of the present invention with flashlight and screwdriver being shown in phantom, and FIG. 2 is a cross-sectional view taken on line 2—2 of FIG. 1, in the direction of the arrows.

A holder 10 in accordance with the present invention is shown in FIG. 1 consisting of a wire framework 12 of approximately the same size and shape of the flashlight it is to hold. The flashlight 14 is shown in phantom in the drawing.

The wire framework 12 is flexible so that flashlight 14 can be squeezed into the framework through access 16 and held securely therein.

The framework can be made of plastic or any other material as long as it possesses sufficient flexibility to allow the flashlight to be squeezed into the holder.

Holder 10 is provided at its front end with clamp 18 adapted to clamp the handle 20 of screwdriver 22, also shown in phantom in the drawing. In this instance clamp 18 is of the type that is tightened by turning screw 24.

It will be seen that the clamp is positioned to hold the screwdriver along the axis of the flashlight so that as little light as possible will be blocked by the screwdriver.

Additionally, when a need for this combination arises the flashlight can be quickly squeezed into the holder and the screwdriver secured by simply turning the screw on the clamp.

Although only a single embodiment of the present invention has been described herein, it will be realized that there are other embodiments which fall within the spirit and the letter of the appended claims.

I claim:

1. A flashlight holder comprising a wire basket of the approximate size and shape of the flashlight it is to contain, said basket being flexible and having an opening of the size and shape of the flashlight it is to contain, said opening being devoid of basket frame members permitting the flashlight to be manually squeezed therein and held thereby, said holder having an axially mounted screwdriver extending from its front end.

* * * * *